United States Patent [19]

Borresen et al.

[11] Patent Number: 4,920,713

[45] Date of Patent: May 1, 1990

[54] PREFABRICATED WINDOW FOR INSTALLATION IN AN INCLINED ROOF

[75] Inventors: Bjarne Børresen, Søborg; Hans C. Blumensaadt, Virum, both of Denmark

[73] Assignee: V. Kann Rasmussen Industri A/S, Soborg, Denmark

[21] Appl. No.: 423,195

[22] Filed: Oct. 18, 1989

[51] Int. Cl.[5] ..... E04B 7/18

[52] U.S. Cl. ..... 52/200; 52/712; 52/714; 206/325

[58] Field of Search ..... 52/200, 712, 714; 16/226, 389, 392; 206/325

[56] References Cited

FOREIGN PATENT DOCUMENTS

WO88/04348 7/1988 PCT Int'l Appl. .

OTHER PUBLICATIONS

"The Complete Guide to Roof Windows & Skylights", p. 14, Velux brochure, 1989 Edition.

*Primary Examiner*—Henry E. Raduazo

*Assistant Examiner*—Lan Mai

*Attorney, Agent, or Firm*—Lane & Aitken

[57] ABSTRACT

A bracket for fixing a prefabricated window to roof boards or sheathing in an inclined roof is already secured to the window main frame during the factory assembling of the window. The presecuring of the bracket is effected by a screw inserted through a hole in a positioning member which through a connecting portion consisting of a bridge and a rodlike member is integrally connected with one side edge of a first leg of the bracket. The first leg continues at its lower side into a second leg at right angle to the first leg. Before packaging the window for transportation the first and second legs are swung into abutment on the main frame by turning around the connecting portion. When the window is to be installed in the roof the first and second legs are swung through an angle of 180° until the first leg abuts against the positioning member. In this position mounting screws are through the overlapping holes screwed into the main frame. Then the window is secured to the roof boards by driving screws or nails through the holes in the second leg into the boards.

7 Claims, 2 Drawing Sheets

PREFABRICATED WINDOW FOR INSTALLATION IN AN INCLINED ROOF

BACKGROUND OF THE INVENTION

The invention relates to a prefabricated window for installation in an inclined roof of the type having a supporting structure, a sheathing secured to the supporting structure, and a roofing fixed to the sheathing, the window comprising a main frame with an outer sidewall and a plurality of mounting brackets.

Inter alia the disclosure of international patent application No. PCT/EP87/00758, published under No. WO 88/04348, deals with a roof window for installation in a roof of the type having a supporting structure carrying lathes to which the roofing is secured. The window is prefabricated and is delivered together with loose mounting brackets.

When the window is to be installed it should be positioned in relation to the inwards facing surface of the roofing in such a manner that the main frame is protruding a predetermined distance outwards from the said roofing and is parallel to the roof inclination. Thus, it is ensured that the flashing and the side members of the flashing will fit on the frame and under the roofing.

In roofs having a sheathing to which the roofing is secured, the window is normally fixed atop the sheathing in which there is cut a rough opening depending on the size of the window. Due to the fact that the main frame is placed atop the sheathing there is no need for adjusting the mounting brackets with respect to the main frame and, accordingly, they could be secured to the frame in factory so that upon installation they are only to be secured to the sheathing. This entails the advantages of firstly ensuring a correct positioning of the mounting brackets on the frame, secondly avoiding the risk of loosing one or more brackets before the window is to be installed and, thirdly reducing the working time consumed by installing the window.

However, if the known window bracket consisting of two legs at a right angle to each other is mounted in factory on the main frame, the free leg of the brackets protrudes sidewise out from the frame, thereby necessitating a larger packaging to be used during storing and transportation of the window. In addition to this cost causing disadvantage, the brackets are also sensible to damage on the brackets themselves or on other objects being possibly scratched or ripped by the protruding legs.

SUMMARY OF THE INVENTION

It is an object of the invention to provide a window of the type initially referred to, with brackets mounted in factory without involving the above mentioned disadvantages.

This is according to the invention obtained in that each mounting bracket comprises a first leg, a second leg forming an angle with the first leg, a positioning member having a hole for a mounting means, and a portion connecting the first leg integrally with the positioning member, the positioning member being secured to the outer sidewall of the main frame in such a position that during transportation of the window the first leg is abutting against the main frame and the second leg is situated below the main frame, whereas during installation of the window the first leg is swung into a position in which it abuts against the positioning member and the second leg is outside the main frame and ready for fixation to the sheathing, the connecting portion defining the axis of said swinging of the first and second legs in relation to the positioning member.

The positioning member and the connecting portion allow, on one hand, the brackets to be positioned correctly on the main frame during the prefabrication and, on the other hand, that the brackets may be brought into the transport position in which the first and second legs by and large are flush with the main frame.

In a preferred embodiment which provides for productional low cost and very reliable mounting brackets, the mounting bracket is made of a single piece of sheet metal by punching, stamping and bending, thereby defining a lower side and a first and a second side edge on the first leg which at its lower side continues into the second leg and at its first side edge continues into the positioning member, the second leg being at a right angle to the first leg.

The positioning member may further be flush with the first leg, in which case the positioning member may be secured to the main frame at any convenient time before packaging the window for transport.

In another embodiment the positioning member is perpendicular to both the first and the second leg. This mounting bracket is used when the brackets in addition to their traditional usage should also serve as positioning means for the main frame while assembling the window. Immediately after assembling the main frame, the brackets are secured to the outer sidewalls thereof and the first and second legs stand out from the sidewalls and e.g. serve as support or guiding means for the frame in an assembling line. When the windows are to be packaged for transport the first and second legs are pushed to turn about the connecting portion until they are parallel to or flush with the frame.

In yet another preferred embodiment according to the invention the positioning member has a first and a second opposite side edge and the connecting portion includes a bridge connecting the central portion of the first side edge of the positioning member with the middle of a rodlike member which at its ends is integral with the first side edge of the first leg. Such a bridge and rodlike member have been found to function as a kind of "piano hinge", because when the first leg is turned in relation to the positioning member, the rodlike member is subjected to a permanently torsional deformation and a slight sidewise deflection so that a 180° turning of the first leg from the transport position causes the first leg to be parallel with and in full abutment on the positioning member. Thus, there will be no need for pulling the first leg closer to the main frame when the mounting screws are tightened or the mounting nails are driven home.

BRIEF DESCRIPTION OF THE DRAWINGS

A preferred embodiment according to the invention will now be described in more detail with reference to the schematical drawings, in which.

DESCRIPTION OF THE PREFERRED EMBODIMENT

Figure 1:
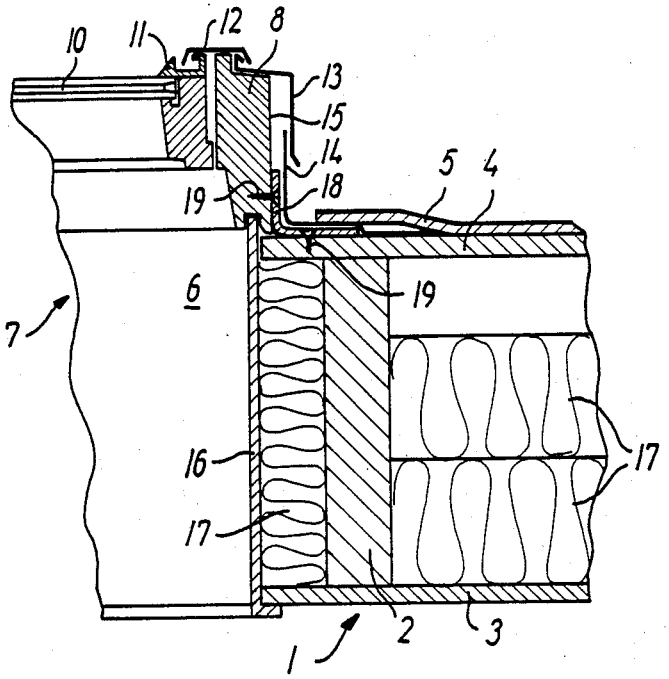
FIG. 1 is a cross-sectional view of the a cutout of a window according to the invention mounted in a roof.

FIG. 1 illustrates a roof construction generally designated 1. The roof has a supporting structure in the form of spars or rafters 2. An inner roof 3 is fixed to the inner side of rafters 2 carrying on the outer side a sheathing 4 e.g. consisting of boards of plywood normally having the dimensions of 8 feet×4 feet×1 inch. The sheathing is surmounted by a roof covering or roofing 5 consisting of e.g. shingles or slate boarding or asphaltic felt or roof tiles. A cutout is provided in the roof in which a roof window 7 is installed. A window main frame 8 carries a sash 9 in which a double pane insulating glass 10 is held by a glazing bead 11. With a view to protect the sash and frame against weather they are provided with a top cladding 12, a side cladding 13 and a flashing 14 covering the lower part of the outer side wall 15 of main frame 8 and extending out under roofing 5. The cut-out in the roof construction is covered by a lining member 16. There may be provided an insulation 17 in the roof. The window is secured in the roof by mounting brackets 18 fixed by nails or screws 19 to main frame 8 and sheathing 4, respectively. Two or more brackets may be provided on each longitudinal side piece of frame 8.

Figure 2:
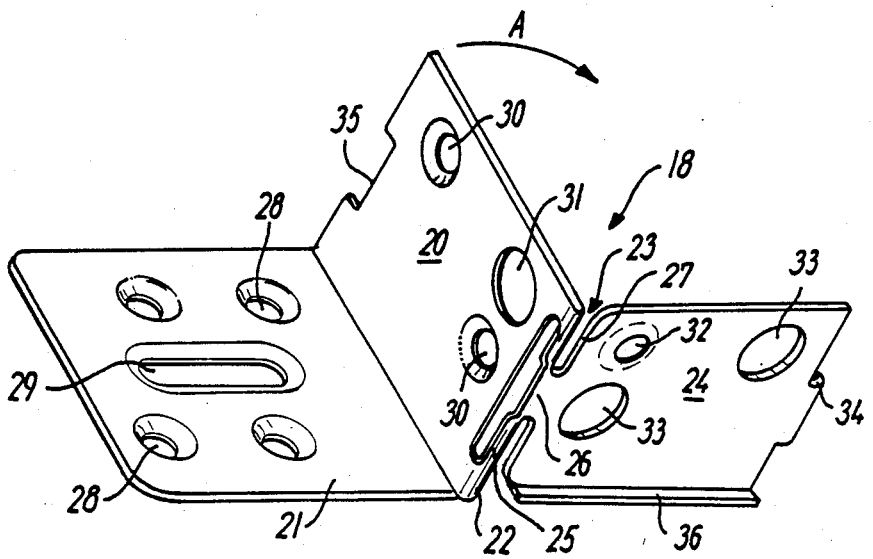
FIG. 2 is a perspective view of a mounting bracket according to the invention.

The mounting bracket 18, viewed from the main frame side in FIG. 2, has a first leg 20 and a second leg 21 extending at a right angle from the lower side of the first leg. At a side edge 22 the first leg continues via a connection portion 23 into a positioning member 24 perpendicular to the first leg as well as to the second leg. The connecting portion 23 consists of a rodlike member 25 integral at its ends with first leg 20, and a bridge 26 uniting the central portion of a first side edge 27 of positioning member 24 with the middle portion of rodlike member 25.

The second leg 21 has four holes 28 and one oval orifice 29 for mounting screws or nails. Holes 28 and orifice 29 are surrounded by depressions for receiving the head of the screws or nails. The first leg has two similar mounting holes 30 and a hole 31 with a larger diameter for allowing admission to a mounting hole 32 surrounded by a depression in member 24.

When first leg 20 and second leg 21 are swung in relation to member 24 in the direction of arrow "A" into a position where the first leg with its back side abuts against the front side of member 24, the depressed holes 30 are received in holes 33 of larger diameter.

At the edge opposed to edge 27 member 24 has an angular projection 34 which by entering a corresponding cut-out 35 in a second side edge of first leg 20 controls the final turning of the first leg into the installation position so that the lower side of said first leg and thereby also the second leg are parallel to a turned back edge 36 at the lower side of member 24.

Bracket 18 may be made from a single piece of sheet metal by punching, stamping or bending. Connecting portion 23 may be formed by punching out an oval hole along side edge 22 and one top slit and one bottom slit at edge 27. The material of the mounting bracket including bridge 26 and rodlike member 25 is chosen in such a manner that first leg 20 may be turned from the position shown in FIG. 2 through an angle of 90° into the transport position in which the first leg and member 24 are flush, following which it may be turned in the direction of arrow A through an angle of 180° into the installation position without causing any breaks or other damages to the bracket material.

Figure 3:
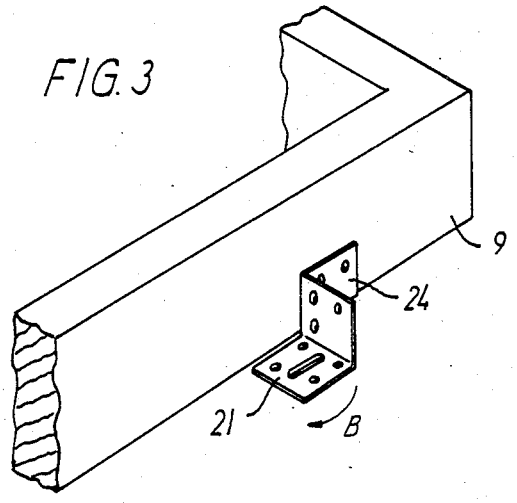
FIGS. 3 to 5 are very schematical views illustrating a mounting bracket in the assembling position, in the transport position and in the installation position, respectively.
Figure 4:
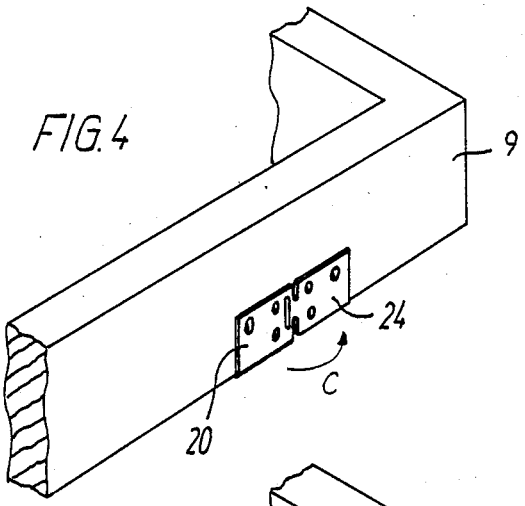
Figure 5:
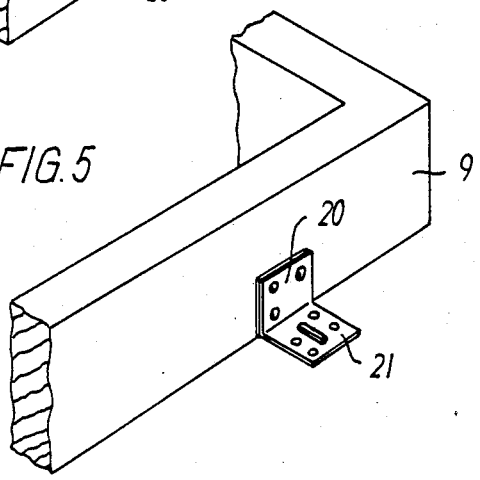

The different steps of mounting the bracket will now be described with reference to FIGS. 3 to 5. When the main frame has been assembled, the bracket is positioned on the frame with positioning member 24 abutting against the outer side wall. The turned back edge 36 may rest along the underside of frame 9 or may engage a recess formed in said underside. A mounting screw is screwed into the frame through hole 32, thereby fixing the member 24 to frame 9. When the entire window has been assembled, a force is exerted on the first leg, thereby swinging it together with the second leg in the direction of arrow B into abutment on the main frame as shown in FIG. 4. The window can now be packaged and transported to the installation site. After unpackaging, the first and second legs are swung 180° in the direction of arrow C until first leg 20 abuts on member 24. In this position the final fixation of bracket 18 to main frame 9 is effected by screws or nails inserted through overlapping holes 30 and 33. After a final adjustment of the window position with respect to the cut-out hole in sheathing 5, the window is secured to said sheathing by screws or nails introduced through holes 28.

We claim:

1. A prefabricated window for installation in an inclined roof of the type having a supporting structure, a sheathing secured to the supporting structure, and a roofing fixed to the sheathing; the window comprising a main frame with an outer sidewall and a plurality of mounting brackets, wherein each mounting bracket comprises a first leg;

a second leg forming an angle with the first leg;

a positioning member having a hole for a mounting means; and a portion connecting the first leg integrally with the positioning member;

the positioning member being secured to the outer sidewall of the main frame in such a position that during transportation of the window the first leg is abutting against the main frame and the second leg is situated below the main frame, whereas during installation of the window the first leg is swung into a position in which it abuts against the positioning member and the second leg is outside the main frame and ready for fixation to the sheathing;

the connecting portion defining the axis of said swinging of the first and second legs in relation to the positioning member.

2. A prefabricated window according to claim 1, and wherein the mounting bracket is made of a single piece of sheet metal by punching, stamping and bending, thereby defining a lower side and a first and a second side edge on the first leg which at its lower side continues into the second leg and at its first side edge continues into the positioning member, the second leg being at a right angle to the first leg.

3. A prefabricated window according to claim 2, and wherein the positioning member is flush with the first leg.

4. A prefabricated window according to claim 2, and wherein the positioning member is perpendicular to both the first and the second leg.

5. A prefabricated window according to claim 4, and wherein the positioning member has a first and a second opposite side edge and the connection portion includes a bridge connecting the central portion of the first side edge of the positioning member with the middle of a rodlike member which at its ends is integral with the first side edge of the first leg.

6. A prefabricated window according to claim 5, and wherein the first leg has holes for mounting screws or mounting nails for securing the first leg to the window frame;

the positioning member has holes corresponding to the holes in the first leg when this has been swung into the installation position; and the second leg has holes for mounting screws or mounting nails for securing the mounting bracket to the sheathing.

7. A prefabricated window according to claim 6, and wherein the second side edge of the positioning member carries a protrusion adapted to engage with a cut-out in the second edge of the first leg when the positioning member and the first leg are in mutual abutment in the installation position.

* * * * *